United States Patent [19]

Fukutani et al.

[11] 4,042,391

[45] Aug. 16, 1977

[54] PROCESS FOR FORMING VESICULAR PHOTOGRAPHIC IMAGES BY EMPLOYING SIMULTANEOUS ACTINIC LIGHT AND INFRA-RED REFLEX EXPOSURE

[75] Inventors: Hideo Fukutani, Tokyo; Hiroshi Oba; Akane Okada, both of Yokohama; Atsuko Shimizu, Tokyo, all of Japan

[73] Assignee: Mitsubishi Chemical Industries Ltd., Tokyo, Japan

[21] Appl. No.: 571,051

[22] Filed: Apr. 24, 1975

[30] Foreign Application Priority Data

| | | |
|---|---|---|
| Apr. 25, 1974 | Japan | 49-46882 |
| July 24, 1974 | Japan | 49-84894 |
| Sept. 18, 1974 | Japan | 49-107339 |

[51] Int. Cl.[2] ..... G03C 5/10; G03C 5/20

[52] U.S. Cl. ..... 96/47; 96/27 R; 96/48 HD; 96/49; 427/55; 427/56; 250/316; 250/317

[58] Field of Search ..... 96/27 R, 47, 48 HD, 96/49; 427/55, 56; 250/316, 317

[56] References Cited

U.S. PATENT DOCUMENTS

| | | | |
|---|---|---|---|
| 2,703,756 | 3/1955 | Herrick et al. | 96/49 |
| 2,911,299 | 11/1959 | Baril et al. | 96/49 |
| 2,916,622 | 12/1959 | Nieset | 250/317 |
| 3,189,455 | 6/1965 | Daech | 96/49 |
| 3,194,659 | 7/1965 | Baus | 96/47 |
| 3,260,599 | 7/1966 | Lokken | 96/49 |
| 3,298,833 | 1/1967 | Gaynor | 96/27 R |
| 3,408,192 | 10/1968 | Aebi | 96/49 |
| 3,410,686 | 11/1968 | Prater | 96/49 |
| 3,457,071 | 7/1969 | Notley et al. | 96/49 |
| 3,536,490 | 10/1970 | Hochberg | 96/47 |
| 3,785,821 | 1/1974 | Notley | 96/48 HD |

FOREIGN PATENT DOCUMENTS

| | | | |
|---|---|---|---|
| 850,954 | 10/1960 | United Kingdom | 96/49 |

*Primary Examiner*—Charles L. Bowers, Jr.
*Attorney, Agent, or Firm*—Oblon, Fisher, Spivak, McClelland & Maier

[57] ABSTRACT

A vesicular image is prepared by contacting an original with a vesicular photograhic element, wherein the element contains a decomposing photosensitive material; and irradiating said element with light containing infrared light from the element side of said contacted image and element.

9 Claims, 30 Drawing Figures

PROCESS FOR FORMING VESICULAR PHOTOGRAPHIC IMAGES BY EMPLOYING SIMULTANEOUS ACTINIC LIGHT AND INFRA-RED REFLEX EXPOSURE

BACKGROUND OF THE INVENTION

1. Field of the Invention

The present invention relates to a process for forming a vesicular image. More particularly, it relates to a novel process for forming a vesicular image in positive-positive or negative-negative format by using a vesicular photographic element which contains, in a synthetic resin, photosensitive material capable of vaporizing after exposure to a light source.

2. Description of the Prior Art:

Heretofore, the following process has been applied for forming an image on a vesicular photographic element 1 (FIG. 1). Referring to FIG. 1, the vesicular photographic element (1) is contacted with a transparent original 2 (A-1). The film 1 is exposed to ultraviolet rays transmitted through the original side whereby the photosensitive material is decomposed to generate a gas (formation of latent image) (A-1). The film is then heated to form a vesicular image in the exposed portion (formation of visible image) (A-2). Thus, the formation of the vesicular image itself is attained by the steps of (A-1) to (A-2). If desirable, the vesicular image can be further stabilized by the following steps. First, the unexposed photosensitive material is decomposed by irradiation of ultraviolet rays on the entire surface (A-3). The gas generated by step (A-3) is discharged by diffusion by allowing the film to set for several hours before further processing (A-4). As is clear from the foregoing discussion, the vesicular image produced by steps (A-1) to (A-2) or (A-1) to (A-4) is positive in the case of a negative original 2 and is negative in the case of a positive original. That is, vesicles are formed in that part of the vesicular photographic substrate 1 corresponding to the transparent part of the original. Since light is reflected in the vesicular portion to produce a visible image, the originally transparent section of the image will be reflective instead. On the other hand, in a projected image of a vesicular photograph, the vesicular part is the negative part.

In order to reproduce a positive vesicular image from a positive original 2 or to reproduce a negative vesicular image from a negative original 2, the following operations are performed after step (A-1). The gas generated by step (A-1) is discharged by diffusion out of the vesicular photographic element 1 by allowing it to set for several hours without heat (B-1). The undecomposed photosensitive material in (A-1) is then decomposed by irradiation with ultraviolet rays over the entire surface thereby generating gas (B-2). A vesicular image is then formed by heating, thereby yielding vesicles only in the regions where the gas generated by step (B-2) exists, (B-3). Consequently, in order to form a positive image from a positive original on a vesicular photographic element 1, it is necessary to combine several steps: the irradiation of image light; the setting step; the irradiation of the entire surface; and the heating step. Accordingly, the operation is complicated. Furthermore, in the conventional process, the light transmitted through the original 2 must reach the vesicular photographic substrate 1 as the image light. Accordingly, the supporting structure for original must be transparent to this light. In summary, vesicular photography has an advantage in that it forms an image by dry processes, but it has the disadvantages that it requires a complicated operation and the use of an original 2 formed on a transparent support. Consequently, it would be most desirable if these disadvantages could be overcome, thereby making vesicular photography a much more attractive process. (Note that throughout the specification, the terms "vesicular photographic substrate" and "vesicular photographic film " are used interchangeably.)

SUMMARY OF THE INVENTION

Accordingly, it is an object of the present invention to overcome the above-mentioned disadvantages of the prior art complicated operation and to provide an image from an opaque original 2.

This and other objects of this invention, as will hereinafter be made clear from the ensuing discussion, have been attained by providing a process for forming a vesicular image by contacting an original with a vesicular photographic element wherein the element contains a decomposing photosensitive material and irradiating the element with light containing infrared light from the element side of the contacted original and substrate 1. This includes providing a process for forming a vesicular image by contacting an original image with a vesicular photographic element and, from the side of the photographic element 1, simultaneously irradiating it with light including infrared rays and light of a wavelength to which the vesicular photographic element is sensitive. The invention also provides a process for forming a vesicular image by irradiating light of wavelengths to which the vesicular photographic element is sensitive, and then, contacting an original image with the exposed vesicular photographic element and irradiating it with light including infrared rays from the side of the photographic element 1 to form a positive image from a positive original.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein.

DETAILED DESCRIPTION OF THE PREFERRED EMBODIMENTS

Figure 1:
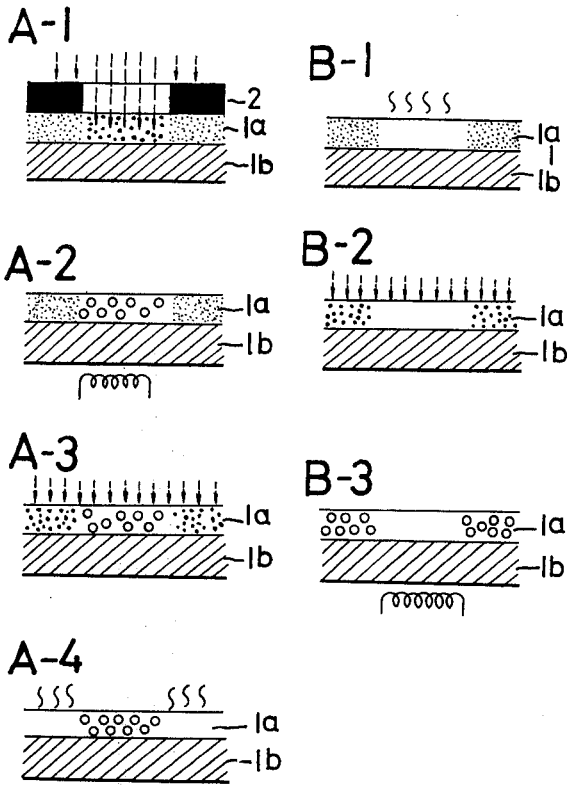
FIG. 1 A-1 - A-4 and B-1 - B-3 show conventional steps of forming a vesicular photographic image.

Referring to the drawings, several embodiments of the invention will be illustrated. The vesicular photographic element used for the invention is prepared by dispersing or dissolving in a thermoplastic and/or thermosettable resin a photosensitive material which generates gas when irradiated by light. This is then coated onto a suitable support 1b to form a photosensitive layer 1a. Suitable thermoplastic resins include polyvinylidene chloride, vinylidene chloride copolymers, vinyl chloride copolymers, thermoplastic epoxy resins and the like. Suitable thermosettable resins include reactive resins containing isocyanate as a hardener.

Suitable photosensitive materials which generate gas when irradiated with light and which are mixed into the synthetic resins include compounds having a diazo group (—N=N +) or an azido group (—$N_3$). Suitable photosensitive materials include: diazonium compounds such as p-diazodimethylaniline zinc chloride salt, p-diazophenylaminesulfate, p-diazoethylaniline zinc chloride salt, p-diazoethylhydroxyethylaniline zine chloride salt, p-diazoethylmethylaniline zinc chloride salt, 4-morphorinobenzenediazonium chloride and the like; and azido compounds such as 2-azido-1, 4-quinone and derivatives thereof and the like. It is also possible to include other additives such as dyes for improving the characteristics of the photosensitive layer. Suitable supports 1b include infrared transmissive films made of polyesters, polyethylene, polypropylene, acrylic resin, cellulose resin and the like. In some applications, a support 1b is unnecessary.

The vesicular photographic element 1 can be prepared by dissolving the synthetic resin and the photosensitive material in a suitable solvent, e.g., methyl ethyl ketone or the like, and coating it on the support 1b, followed by drying the product. Sometimes, the solution of the resin and the photosensitive material is shaped to form a film. The thickness of the photosensitive layer 1a is not critical and is usually less than 100 μm, preferably less than 50 μm, and is especially preferred to be 3 - 20 μm. Suitable commercial vesicular photographic substrates 1 include Kalvar films, e.g., Mikrolith 100, Mikrolith 150, Mikrolith 200, Mikrolith 500 and Kalvalith manufactured by Kalvar Corporation (U.S. Trademarks).

In the process for forming a vesicular image according to the invention, it is necessary to simultaneously irradiate light including infrared rays and light of wavelengths to which the photosensitive element is photosensitive so as to decompose the photosensitive material and to form the vesicular image at the same time; or to irradiate light to which the photographic element 1 is sensitive and, then, to irradiate light including infrared rays. The wavelengths of the light to which the photographic element 1 is sensitive depend upon the nature of the photosensitive material and the additive (s). The appropriate radiation usually has wavelengths of 200 mμm - 600 mμm, especially 300 mμm - 550 mμm. The photosensitive region of the commercially available Kalvar film is 340 mμm - 450 mμm, with a peak of 385 mμm - 400 mμm. Suitable light sources for the radiation of the photosensitive region include ultraviolet fluorescent lamps, mercury lamps, and the like. The light including infrared rays comprises infrared rays having wavelengths longer than 800 mμm, alone or mixed with other radiation. The light source preferably generates high intensity radiation for a short time. Suitable light sources include infrared lamps, schillerization sources utilizing the combustion of aluminum or magnesium or the like, excitation lamps and flash lamps utilizing a discharge in a rare gas, e.g., xenon, krypton, argon and the like. The emanations of the schillerization sources, the excitation lamps, and the flash lamps, except for the infrared lamps, include light of wavelengths in the photosensitive region for the photographic substrate 1 as well as infrared rays. The exposure time for irradiation by the light source depends upon the intensity of the light source, the distance to the photographic element 1, and other factors. It usually is from several seconds to 30 seconds in the case of the ultraviolet fluorescent lamp and the mercury lamp; and less than 1 second in the case of the schillerization sources, the excitation lamps and the flash lamps. It is unnecessary to carry out the process in a dark room, but rather an office room, for example, will suffice. This is a significant advantage over the requirements for the irradiation of the conventional silver salt type film.

In accordance with the process of this invention (FIG. 2), an original 2 is contacted with a vesicular photographic element 1. Light including infrared rays and light of wavelengths within the photographic region of the photographic element is irradiated over the entire surface of the element from the side of the photographic element 1 that is reflexexposed, whereby the photosensitive material in the vesicular photographic element 1 is decomposed to generate gas. Simultaneously, infrared rays are absorbed only at that portion of the original 2 which contains an image, i.e., the opaque regions; thereby heat is generated and only the vesicles of the photosensitive layer 1a which are in contact with the original image are expanded to form a vesicular image on the photographic element 1 corresponding to the original image. Heat is not generated at the portions of the element not in contact with the original image. Consequently, the small vesicles of the photosensitive layer 1a at these portions are not expanded and no image is formed. The result is that the image formed in the vesicular photographic element 1 is the same as that of the original 2, that is, the copy has the same sign as the original. (The light including both infrared rays and light of wavelengths within the photosensitive region is irradiated as shown in FIG. 2, C-2.)

Figure 2:
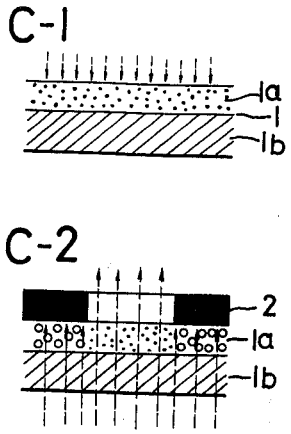
FIG. 2 C-1 2-1 - C-2 show the steps of forming a vesicular photographic image according to the invention.

When the light having wavelengths within the photosensitive region and having no infrared portion is irradiated on the photographic element 1 from the side of the photographic element 1, the photosensitive material in the photosensitive layer 1a is decomposed (FIG. 2 C-1). The original 2 is then contacted with the vesicular photographic element 1 and light including infrared rays is irradiated whereby the infrared rays are absorbed, as above, only at those portions of the original 2 containing an image thereby generating heat. Only the small vesicles in the photosensitive layer 1a in contact with the original image are expanded to form a vesicular image in the photographic element 1 corresponding to the original image (FIG. 2 C-21). As with the first process, heat is not generated at the locations not in contact with the original image. The small vesicles of the photosensitive layer 1a at these positions are not expanded and no image is formed. Once again, the result is that the image formed in the vesicular photographic substrate 1 is the same as that of the original 2.

Figure 3:
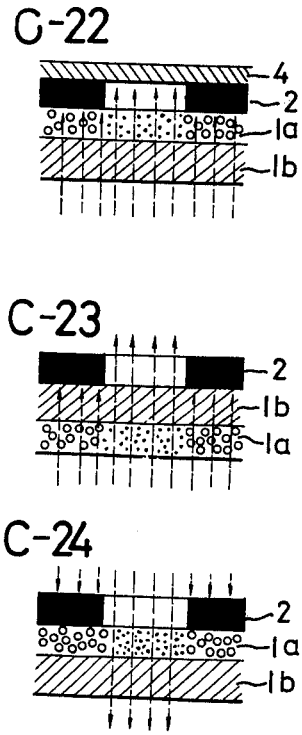
FIG. 3 C-22-C-24 show the steps of forming a vesicular photographic image according to the invention.

In the process of this invention, it is necessary to generate heat at the locations of the image on the original 2. Accordingly, the original image is preferably formed with material capable of generating satisfactory heat energy such as black pigment, black ink, printing ink, pencil and the like. Of course, it is still possible to form an image by irradiating the light including infrared rays for a sufficiently long time when an original is not so treated. In order to prevent heat loss, it is preferable to cover the black surface of the original 2 with a heat insulating plate 4 on the side opposite to the direction of irradiation (FIG. 3 C-22).

When the original 2 is contacted directly with the support 1*b* and the light is irradiated from the side of the photographic element 1 (FIG. 3 C-23), the heat generated at the locations of the original image must be transmitted through the support 1*b* to the photosensitive material. Accordingly, the heat efficiency is decreased and much longer times are disadvantageously required for the irradiation. Consequently, it is preferably to contact the photosensitive layer 1*a* directly with the original 2. When the original 2 is contacted with the photosensitive layer 1*a* and the light is irradiated from the side of the original (FIG. 3 C-24), heat is generated at the surface of the original 2, and must be transmitted through the original 2 to the photosensitive material. Accordingly, the heat efficiency is low in this case also.

As stated above, in accordance with the invention, it is possible to form a positive vesicular image from a positive original 2 or to form a negative vesicular image from a negative original 2 by exposure to light only. A clear image can be obtained and the durability of the image is excellent. Additionally, in accordance with the invention, it is possible to irradiate light from the side of the photographic element 1. Accordingly, it is unnecessary to use a transparent original as with the conventional process and the vesicular image can be formed from an opaque original 2. Consequently, it is possible to form a vesicular image directly from an original such as normal printed matter, hand-written originals, and originals having records on both sides. Furthermore, the product prepared by coating the photosensitive layer 1*a* on a suitable transparent support 1*b*, such as a polyester film, has high mechanical strength and its handling is easy. When this product is used as the original for an overhead projector, it is much more easily handled than an original for an overhead projector utilizing heat shrinkage of the film. Moreover, the vesicular image formed in accordance with this invention has high contrast. Accordingly, the projected image is quite clear. When this invention's product having the vesicular image is used as an original for diazo type reproduction, it is possible to obtain a clear diazo type copy. Optionally, when the photosensitive layer 1*a* is coated onto a transparent article and a vesicular image is formed, the products can be used as ornaments.

The process of the invention can also be applied for copying an original wherein both a transparent part and an opaque part are present simultaneously, such as an aperture card used in the microfilm field. The process of the invention is especially effective for production and reproduction of such cards. Aperture cards comprise a record on a transparent support (microfilm) and a record (information describing the microfilm) on an opaque support, e.g. paper (card). It is difficult to copy both the record on the transparent support and the record on the opaque support at the same time by the conventional reproduction techniques. Accordingly, in the preparation of the aperture card, the preparation of the microfilm (exposure development or copy) is conducted separately from the preparation of the record on the card. Then, using an adhesive composition, the microfilm is adhered to the aperture of the card. Alternately, the microfilm is inserted into a transparent pocket in the aperture of the card. Since the card and the microfilm are separately prepared and assembled, the operation is complicated. In the conventional process, the thickness of the aperture card is not uniform because of the adhesive composition of the pocket. This is a distinct disadvantage where the filing of many aperture cards is required. Furthermore, the aperture cards often become adhered to each other by excess adhesive composition. Accordingly, there is a great need to have an aperture card containing both the records on the microfilm and those on the card on one support. However, a satisfactory process has heretofore not been found for preparing or reproducing such a product.

In accordance with the process of this invention, it is possible to copy both a record on a transparent support and a record on an opaque support onto one vesicular photographic element 1 by combining the following steps:

A. Irradiating light of wavelengths within the photosensitive region onto the vesicular photographic element 1 from the side of the original 2 (decomposition of the photosensitive material); and B. Contacting the original 2 with the vesicular photographic element 1 and irradiating it from the side of the photographic element 1 with light including both infrared rays and light of wavelengths within the photosensitive region.

Figure 4:
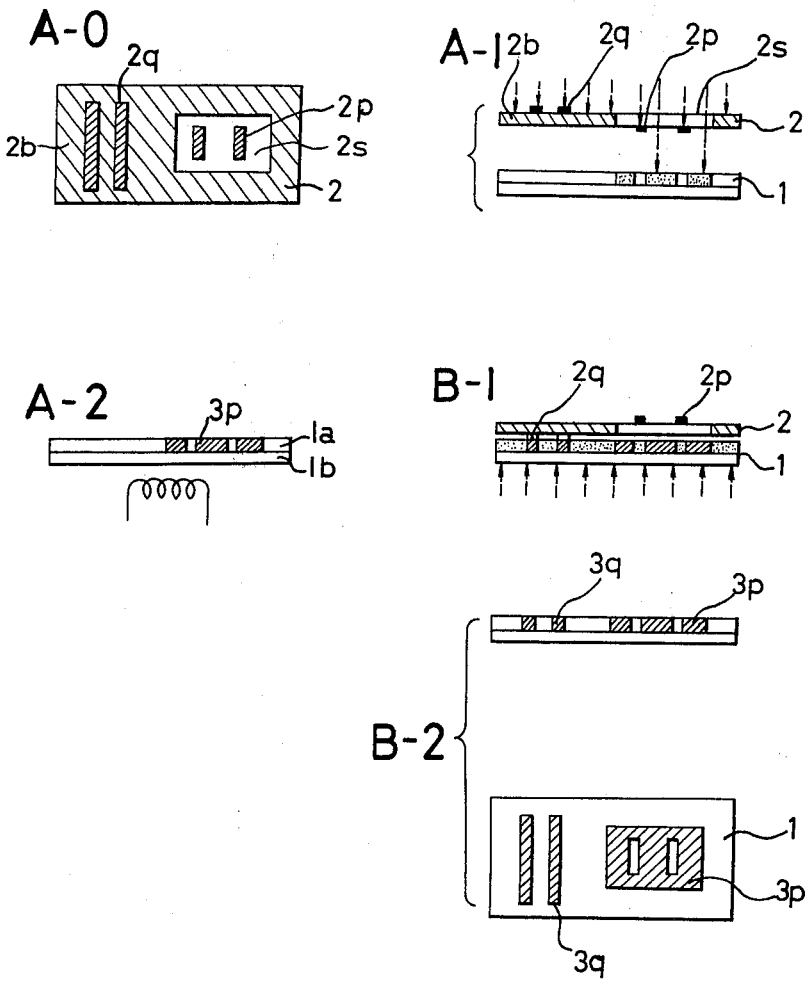
FIG. 4 A-0 - A-2 and B-1 - B-2 show one embodiment of steps A and B of the invention as defined below.

One embodiment of this process will be illustrated. The latent image corresponding to the image 2*p* of the transparent parts 2*s* of the original 2 is formed on the photographic element 1 by step A, wherein light of wavelengths within the photosensitive region is irradiated onto the vesicular photographic element 1 from the side of the original 2 (FIG. 4 A-1). The original 2 can be in contact with or removed from the vesicular photographic element 1. It is only necessary to pass the appropriate light through the transparent part 2*s* of the original to irradiate the vesicular photographic element. When this occurs, the light passes through the non-imaged portion of the transparent part 2*s* to form a latent image (FIG. 4 A-1) on the substrate. When the vesicular photographic substrate 1 is heated to expand the small vesicles in the photosensitive layer 1*a* (FIG. 4 A-2), a vesicular image 3*p* is formed in positive/negative relationship to the image 2*p* of the transparent part 2*s* (FIG. 4 B-2). Then, the image corresponding to the image 2*q* of the opaque part 2*b* of the original 2 is formed on the vesicular photographic element 1 by step B, wherein the original 2 is contacted with the photographic substrate 1 and light-including infrared rays and light having wavelengths within the photosensitive region is irradiated from the side of the photographic element 1 (FIG. 4 B-1). The photosensitive material in the photosensitive layer 1*a* is decomposed by the light within the photosensitive region, whereby a latent image is formed by the generating gas over the entire surface (FIG. 4 B-1). However, a latent image is not formed at the locations of the vesicular image 3*p* of the photographic element 1, because the photosensitive material at those positions has already been decomposed by step A. (The latent image corresponds to the formation of small vesicles). Simultaneous with the formation of the latent image, infrared rays contained in the light are absorbed only at positions of the image 2*q* of the opaque portion of the original, thereby generating heat; whereby only the latent image corresponding to that portion of the photosensitive layer 1*a* in contact with the image 2*q* is expanded to form a vesicular image on the photographic element 1 (FIG. 4 B-1, B-2) corresponding to the image 2*q*. Heat is generated only at those portions in contact with the image of the original 2. The latent image in the photosensitive layer 1*a*, corresponding to other areas, is not expanded. Consequently, no visible image of these areas is formed. Of course, infrared rays are also absorbed at the image 2*p* of the transparent part of the original 2. However, this image 2*p* is not directly in contact with the photosensitive layer 1*a*. The support of the original 2 is present between them. Accordingly, heat is not transmitted to the photosensitive layer 1*a* very quickly, and the latent image is not expanded.

Figure 6:
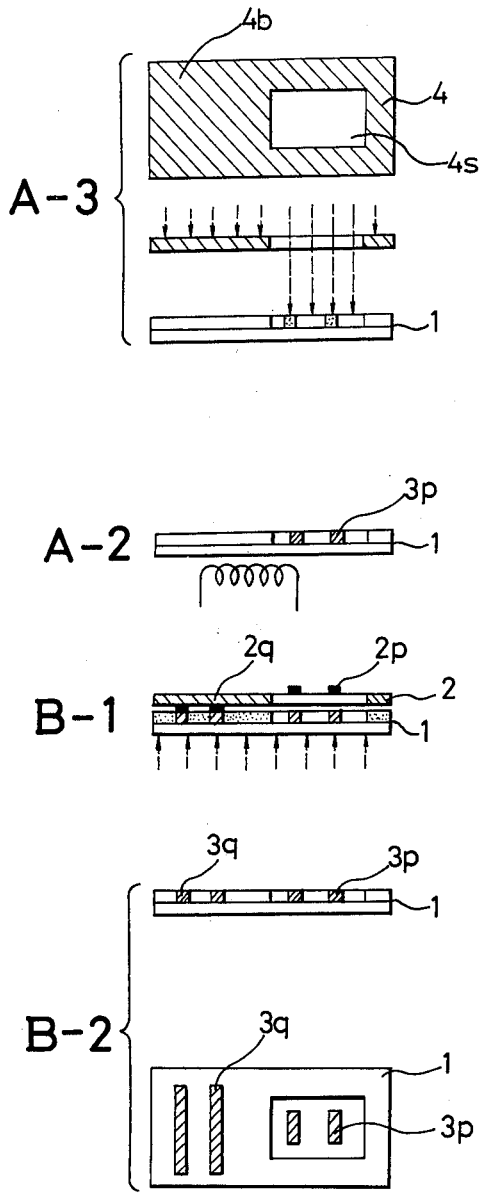
FIG. 6 A-2 - A-3 and B-1 - B-2 show still another embodiment of steps A and B.

When a vesicular image 3*p* is formed in a positive/-positive relationship to the image 2*p* of the transparent part 2*s* (FIG. 6 B-2), the vesicular photographic substrate 1 is treated by step A (FIG. 4 A-1) to form a latent image. The product is allowed to set for several hours to enable the gas of the vesicles to discharge out of the photographic element 1. Then, the same light as used in step A is irradiated through a shield plate 4 having a transparent part 4*s* and an opaque part 4*b* which has the same shape as the original 2, but which has no image on the entire surface of the photographic substrate 1 (FIG. 6 A-3). Thereby, a latent image is formed at the positions unexposed in step A, and a vesicular image 3*p* in a positive/positive relationship to the image 2*p*, is formed by heating (FIG. 6 A-2).

Figure 5:
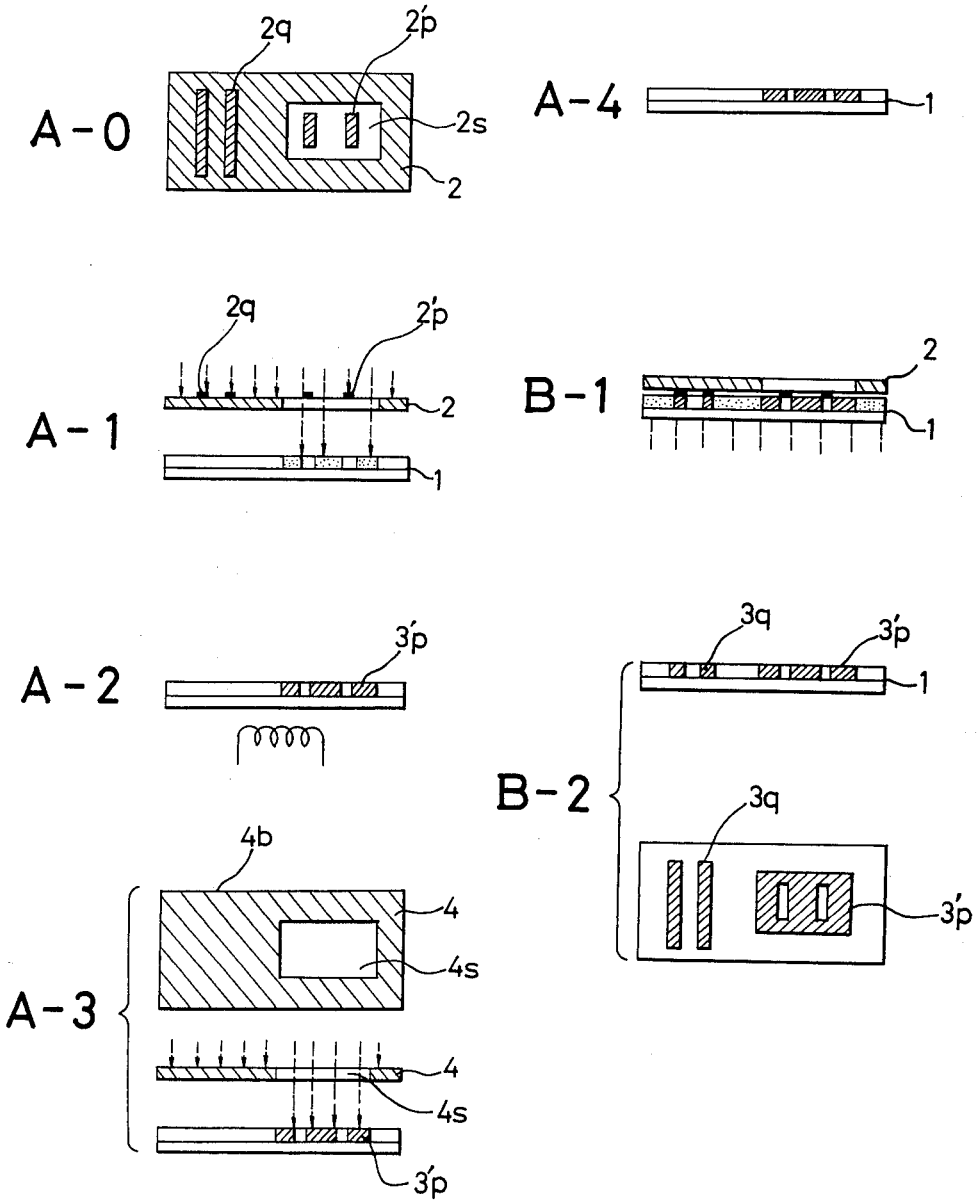
FIG. 5 A-0 - A-4 and B-1 - B-2 show another embodiment of steps A and B.

The vesicular image 3*q* is then formed by step B. The case of an original 2 having an image 2*q* on the front surface and an image 2*p* on the back surface has been illustrated with steps A and B in FIG. 4. However, it is possible to form a vesicular image 3*p* in positive/negative relationship with the image 2*p* of the transparent part 2*s* of the original 2 even if both images are on one surface (FIG. 5 A-0). In the latter case, after step A, (FIG. 5 A-1), the vesicular image 3*p* is formed by heating (FIG. 5 A-2). Then, light from the light source used in step A is irradiated onto the photographic element 1 through plate 4 (FIG. 6 A-3), whereby a latent image is formed at the unexposed part of the photographic element 1 corresponding to the transparent part of the original 2. When the latent image is allowed to set for several hours, the gas in the vesicles are discharged by diffusion out of the photographic element 1 (FIG. 5 A-4). In this case, the vesicular image 3*p* formed by heating in (A-2) is not changed. As described above, the vesicular image 3*q* is then formed by step B.

When the images 2′*p* and 2*q* are present on the same surface (FIG. 5 A-0), a vesicular image 3′*p* can be formed in a positive/positive relationship to the image 2′*p* by combining the above-mentioned steps. That is, step A is applied as shown in FIG. 5 A-1, and the gas in the vesicles is discharged by diffusion by allowing the substrate to set and then the product is treated as shown in FIG. 6 A-3, FIG. 6 A-2, and FIG. 5 B-1 to form a vesicular image 3′*p*.

Figure 7:
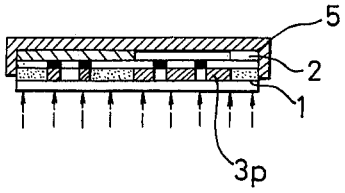
FIG. 7 shows a sectional view illustrating one method of irradiating light in step B.
Figure 8:
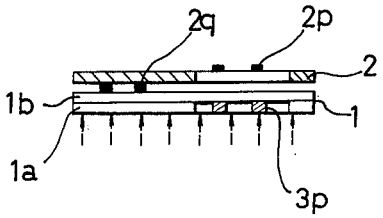
FIG. 8 shows a sectional view illustrating another method of irradiating light in step B.

In order to prevent heat loss, it is preferred to cover the back surface of the original with a heat insulating plate 5 (FIG. 7). In step B, from the viewpoint of heating efficiency, it is preferred that the original 2 be in contact with the photosensitive layer of the vesicular photographic element 1 when infrared rays are irradiated (FIG. 6 B-1). When the original 2 is in contact with the opposite surface having no photosensitive layer and infrared rays are irradiated (FIG. 8), the heat generated at the image of the original must be transmitted through the support 1*b* to the photosensitive material. Thereby, heat efficiency is quite low, disadvantageously requiring a much longer irradiation time. The case of an original having a transparent part and an opaque part has been illustrated. However, it is possible to form a vesicular image on one photographic element by using two originals, one transparent and the other opaque. It is also possible to apply step B prior to step A if means are taken to prevent irradiation of the portions of the substrate to be exposed by step A, by the light including infrared rays and light within the photosensitive region, for example, by shielding the light with an opaque plate.

It should be noted that although the gas of the latent image (small vesicles) formed by irradiation on light within the photosensitive region is discharged by diffusion out of the photosensitive layer by allowing it to set for several hours, the vesicular image formed by irradiating infrared rays is not changed by passage of long periods of time. This occurs because the infrared radiation causes the generation of heat whereby the vesicular image becomes fixed.

Having generally described the invention, a more complete understanding can be obtained by reference to certain specific Examples, which are included for purposes of illustration only and are not intended to be limiting unless otherwise specified.

EXAMPLE 1

A glass plate is disposed a distance of 7 cm above a xenon flash lamp (output of 1400 WS) having a reflective plate at the lower end. A vesicular film (a layer of polyvinylidene chloride containing p-diazodimethylaniline zinc chloride, coated on polyethylene terephthalate film) was placed on the glass plate providing an emulsifying agent surface at the upper side. An original 2 written with a pencil was faced downwardly and was contacted with the vesicular film. An insulator 5 was placed on the back surface of the original under pressure and irradiation was performed by discharge of the xenon flash. Thereby, a film forming a positive vesicular image which is identical with the original was obtained. The film having the positive image was projected by an overhead-projector to obtain a clear image. A reproduction of the original was formed by a diazo type copying apparatus to obtain a clear copy.

EXAMPLE 2

The vesicular film 1 of Example 1 was exposed for 60 seconds by an exposing apparatus for vesicular photography (Karprinter Automatic manufactured by Cannon K.K.). An original 2 (a newspaper) was put on the sensitive layer 1*a* of the vesicular film 1 and infrared rays were irradiated onto the film 1 from the film side, in a dial-set value of 1, by a heat sensitive copying lithography apparatus (Rithofax BF-11). As a result, a clear positive vesicular image which is identical to the original 2 was obtained. The film having the positive image was projected by an overhead projector to obtain a clear image. A reproduction of the original was formed by a diazo type copying apparatus to obtain a clear copy.

EXAMPLE 3

Ultraviolet rays were irradiated onto the vesicular film 1 of Example 2 for 15 seconds by a high pressure mercury arc lamp (Ushio UMH-3000). An original 2 written with black Japanese ink (on white board) was placed on the film 1. Infrared rays were irradiated in accordance with the process of Example 2, to form the vesicular image. The product was used as a display in a building.

EXAMPLE 4 (FIG. 4)

An original 2 (Aperture card) was prepared by adhering a color developed diazo type microfilm 2*s* to an aperture of a printed paper card 2*b* (letter 2*q* and line *sq* formed with black ink) so that the printed surface was reversed with respect to the diazo type sensitive layer. The original was copied onto the vesicular film 1 of Example 1, as follows:

The color developed diazo type sensitive layer was put on the sensitive layer 1*a* of the film 1 which had the same size as that of the aperture card 2. The vesicular film was exposed for 35 seconds to light in the proper photosensitive region through the microfilm by an exposing apparatus (KAL-printer automatic manufactured by Cannon K.K.) (A-1). The exposed film was developed by a developer (KAL-Developers manufactured by Cannon K.K.) (A-2). The sensitive layer 1*a* of the vesicular film 1 on which the image 2*p* of the microfilm 2*s* was formed was placed on the printed surface of the aperture card. The film 1 having a reflector at its back was exposed by a xenon flash lamp (1400 WS) from a distance of 5 cm (B-1). As a result, the vesicular image 3*p*, 3*q* on the film was quite clear.

EXAMPLE 5

An imaged surface of a silver salt type photographic film 2 was placed on a sensitive layer 1*a* of vesicular film of Example 1. The vesicular film was exposed for 30 seconds by a high pressure mercury arc lamp (500W) from a distance of 50 cm to the contacted portion by using a shield plate 4 (Step A). The vesicular film 1 was developed by heating the film 1 through contact with a metal roller at 130° C. An original 2*q* printed by copy print (the same one used for the silver salt type photography) was put on the unexposed sensitive layer 1*a* of the vesicular film 1 and the film was exposed by the xenon flash lamp (step B). Both the images 2*p* of the silver salt type film and 2*q* of the printed original were clearly copied on the same vesicular film 1.

Having now fully described the invention, it will be apparent to one of ordinary skill in the art that many changes and modifications can be made thereto without departing from the spirit or scope of the invention as set forth herein.

What is claimed as new and intended to be covered by letters patent is:

1. A process for forming a vesicular image which is the same sign as that of the original, which comprises contacting an original with a supported vesicular photographic element comprising a photosensitive material which generates a gas when irradiated by light to which it is sensitive, said material dispersed or dissolved in a thermoplastic or thermosettable resin, wherein the vesicular photographic element while in contact with the original is reflex exposed simultaneously to both infrared rays and light of wavelengths to which said photosensitive material is sensitive through the vesicular element to the original so as to effect decomposition of the photosensitive marerial to generate a gas and formation of the vesicular image simultaneously.

2. The process of claim 1 wherein a portion of the vesicular photographic element has a vesticular image before said element is exposed simultaneously to both infrared rays and light of wave lengths within the photosensitive region of said element.

3. The process of claim 1 wherein the source of the infrared rays and the light of wavelengths within the photosensitive region of said material is a xenon flash lamp.

4. The process of claim 1, wherein the original is opaque.

5. The process of claim 1, wherein the original has an opaque portion and a transparent portion.

6. The process of claim 1, wherein the original is an aperture card.

7. The process of claim 1, wherein the original is contacted with the sensitive layer of the vesicular photographic element.

8. The process of claim 1, wherein the back of the original is covered with a heat insulating plate.

9. The process of claim 1, wherein a part of the photosensitive material of the vesicular photographic element is decomposed by using a shield plate.

* * * * *